United States Patent [19]

Fukui et al.

[11] 4,296,224

[45] Oct. 20, 1981

[54] PERFLUOROALKYL-ACR[METHACR]Y-LATE, HYDROXY-CHLOROPROPYL-ACRYLATE POLYMER

[75] Inventors: Shosin Fukui, Shinsenrihigashi; Tadashi Akazawa, Osaka, both of Japan

[73] Assignee: Daikin Kogyo Co., Ltd., Osaka, Japan

[21] Appl. No.: 79,217

[22] Filed: Sep. 26, 1979

[30] Foreign Application Priority Data

Sep. 28, 1978 [JP] Japan ..... 53-119694

[51] Int. Cl.[3] ..... C08F 220/38; C08F 220/30

[52] U.S. Cl. ..... 526/243; 8/116 R; 427/288; 526/208; 526/209; 526/224; 526/245

[58] Field of Search ..... 526/245, 243

[56] References Cited

U.S. PATENT DOCUMENTS 3,514,420 5/1970 Katsushima ..... 526/245 X
3,624,139 11/1971 Davis ..... 526/245 X
3,645,989 2/1972 Tandy, Jr. ..... 526/245
3,901,864 8/1975 Jäger ..... 526/245 X
3,944,527 3/1976 McCown ..... 526/245 X

FOREIGN PATENT DOCUMENTS 926283 5/1963 United Kingdom ..... 526/245

*Primary Examiner*—C. A. Henderson
*Attorney, Agent, or Firm*—Birch, Stewart, Kolasch & Birch

[57] ABSTRACT

A water and oil repellent essentially consisting of a copolymer comprising units of (a) at least one of fluoroalkyl group-containing polymerizable compounds and of (b) at least one of 2-hydroxy-3-chloropropyl acrylate and methacrylate of the formula:

$$CH_2{=}CRCOOCH_2CH(OH)CH_2Cl$$

wherein R is hydrogen or methyl, which is highly resistant to laundering and dry cleaning.

6 Claims, No Drawings

PERFLUOROALKYL-ACR[METHACR]YLATE, HYDROXY-CHLOROPROPYL-ACRYLATE POLYMER

BACKGROUND AND SUMMARY OF THE INVENTION

The present invention relates to a water and oil repellent having high resistance to laundering and dry cleaning.

Hitherto, it is known that polymers of fluoroalkyl group-containing polymerizable compounds with or without other polymerizable compounds such as acrylic esters, methacrylic esters, chloroprene, vinyl chloride, maleic esters and vinyl ethers are useful as water and oil repellents. It is also known that the choice of hydroxyl group-containing acrylic or methacrylic esters as the compounds to be copolymerized with the fluoroalkyl group-containing polymerizable compounds can enhance the resistance of the resulting polymers to laundering and dry cleaning (cf. Japanese Patent Publication (examined) No. 3798/1975). However, the enhancement of the resistance to laundering and dry cleaning in the latter case is not satisfactorily high. Although the use of some other polymerizable compounds instead of the hydroxyl group-containing acrylic or methacrylic esters has been proposed, the enhancement is still insufficient.

As the result of an extensive study, it has now been found that copolymers comprising units of at least one fluoroalkyl group-containing polymerizable compound and at least one of 2-hydroxy-3-chloropropyl acrylate or methacrylate of the formula:

$$CH_2{=}CRCOOCH_2CH(OH)CH_2Cl$$

wherein R is hydrogen or methyl show excellent water and oil repellency with high resistance to laundering and dry cleaning. Advantageously, they exhibit high stability in water and good solubility into organic solvents.

The reason why the said copolymers show high resistance to laundering and dry cleaning is still not certain. Since, however, their effect onto cellulose fibers having many active hydrogens is much more remarkable than that onto polyester fibers, polyamide fibers, etc., it is presumed that a chemical bonding is produced between the hydroxyl groups or the terminal chlorine atoms and the materials to be treated.

According to the present invention, there is provided a water and oil repellent consisting essentially of a copolymer comprising at least one of fluoroalkyl group-containing polymerizable compounds and at least one of 2-hydroxy-3-chloropropyl acrylate and 2-hydroxy-3-chloropropyl methacrylate. The content of the units of 2-hydroxy-3-chloropropyl acrylate and/or of 2-hydroxy-3-chloropropyl methacrylate in the copolymer may be usually from 0.1 to 10% by weight, preferably from 0.5 to 5% by weight. When the content is less than 0.1% by weight, a sufficient effect in enhancement of the resistance to laundering and dry cleaning will not be produced. When the content is more than 10% by weight, the water and oil repellency is much lowered.

Examples of the fluoroalkyl group-containing polymerizable compounds are $C_3$–$C_{15}$, preferably $C_5$–$C_{10}$, perfluoroalkyl group-containing acrylates and methacrylates of the formula:

$$R_fBOCOCR{=}CH_2$$

wherein $R_f$ is $C_3$–$C_{15}$ perfluoroalkyl, B is $(CH_2)_m$ (in which m is an integer of 2 to 11), $$\overset{OH}{\overset{|}{CH_2CHCH_2}},\ \overset{OCOR'}{\overset{|}{CH_2CHCH_2}}$$

(in which R′ is methyl, ethyl or propyl) or $SO_2N(R'')(CH_2)_l$ (in which R″ is methyl, ethyl or propyl and l is an integer of 2 to 6) and R is as defined above, of which specific examples are as follows:

$CF_3(CF_2)_7(CH_2)_{11}OCOCH{=}CH_2$,
$CF_3(CF_2)_6CH_2OCOC(CH_3){=}CH_2$,
$(CF_3)_2CF(CF_2)_8(CH_2)_2OCOCH{=}CH_2$,
$CF_3(CF_2)_6(CH_2)_2OCOC(CH_3){=}CH_2$,
$CF_3(CF_2)_6(CH_2)_2OCOCH{=}CH_2$,
$CF_3(CF_2)_7SO_2N(CH_3)(CH_2)_2OCOCH{=}CH_2$,
$CF_3(CF_2)_7SO_2N(C_2H_5)(CH_2)_2OCOC(CH_3){=}CH_2$,
$(CF_3)_2CF(CF_2)_6$-$CH_2CH(OCOCH_3)CH_2OCOC(CH_3){=}CH_2$ and
$(CF_3)_2CF(CF_2)_6CH_2CH(OH)$-$CH_2OCOCH{=}CH_2$.

These fluoroalkyl group-containing acrylates and/or methacrylates are usually employed so as to be contained in an amount of not less than 25% by weight on the basis of the weight of the copolymer.

In addition to the said two essential components, the copolymers may comprise optionally units of any other polymerizable compound(s) having no fluoroalkyl group, of which examples are ethylene, vinyl chloride, vinylidene halide, styrene, acrylic acid and its alkyl esters, methacrylic acid and its alkyl esters, benzyl methacrylate, cyclohexyl methacrylate, vinyl alkyl ketone, vinyl alkyl ether, butadiene, isoprene, chloroprene, maleic acid, etc., for the purpose of providing the resulting copolymers with improved physical properties such as high solubility and good water proofing. For instance, the use of stearyl acrylate or methacrylate as such other polymerizable compound(s) having no fluoroalkyl group is effective in enhancing water repellency, elasticity, gum-up inhibiting property to rolls and solubility in organic solvents. In this case, the most preferable is the copolymer comprising units of the fluoroalkyl group-containing polymerizable compound, 2-hydroxy-3-chloropropyl acrylate or methacrylate and stearyl acrylate or methacrylate in contents of not less than 25% by weight, from 0.1 to 10% by weight (preferably from 0.2 to 5% by weight) and from 5 to 74.9% by weight, respectively.

For production of the copolymers of the invention, various conventional polymerization modes and conditions can be adopted. Any of bulk polymerization, solution polymerization, emulsion polymerization, radiation polymerization, etc. may be employed.

One of typical polymerization procedures comprises emulsifying a mixture of the monomeric components to be copolymerized in the presence of a surfactant and subjecting the resultant emulsion to polymerization while stirring. To the reaction system, a polymerization initiator such as peroxides, azo compounds and persulfates is added. As the surfactant, any one chosen from anionic, cationic and non-ionic surface active agents can be used, and a mixture of a cationic surfactant and a non-ionic surfactant is preferably employed.

Another typical polymerization procedure comprises dissolving the monomeric components to be copolymerized into an appropriate organic solvent and subjecting the resultant solution to polymerization in the presence of a polymerization initiation source such as a peroxide or an azo compound soluble in the organic solvent or ionizing irradiation.

The thus prepared copolymers may be used as water and oil repellents in any conventional form such as emulsion, solution and aerosol.

PREFERRED EMBODIMENTS OF THE PRESENT INVENTION

Practical and present preferred embodiments of the present invention are illustratively shown in the following Examples wherein the water repellency is expressed by the water repellency No. (cf. Table 1) determined according to the spray method as described in JIS (Japanese Industrial Standard) L-1005 and the oil repellency is expressed by the oil repellency No. (cf. Table 2) determined by dropping a mixture of n-heptane and Nujol on the surface of a cloth previously applied with the test material and observing the retention of the drop over a period of 3 minutes.

TABLE 1

| Water repellency No. | State |
|---|---|
| 100 | No wet at the surface |
| 90 | Slight wet at the surface |
| 80 | Partial wet at the surface |
| 70 | Wet at the surface |
| 50 | Wet over the whole surface |
| 0 | Complete wet through the surface to the reverse |

TABLE 2

| Oil repellency No. | Mixture composition (% by volume) | |
|---|---|---|
| | n-Heptane | Nujol |
| 150 | 100 | 0 |
| 140 | 90 | 10 |
| 130 | 80 | 20 |
| 120 | 70 | 30 |
| 110 | 60 | 40 |
| 100 | 50 | 50 |
| 90 | 40 | 60 |
| 80 | 30 | 70 |
| 70 | 20 | 80 |
| 60 | 10 | 90 |
| 50 | 0 | 100 |
| 0 | 100% Nujol not retained | |

Resistance to laundering was determined by washing a cloth previously applied with the test material with water containing a cleaning agent ("Zabu Koso XK", a cleaning agent containing as the main ingredient a mixture of sodium higher alcohol sulfate and sodium dodecylbenzenesulfonate; manufactured by Kao Soap Co., Ltd.) in a concentration of 0.3% by weight at 40° C. in a bath ratio of 1:40 (cloth:cleaning agent-containing water by weight) over a period of 5 minutes in a washing machine for domestic use, rinsing the cloth with water for 15 minutes and drying the rinsed cloth at 80° C. for 3 minutes. The above operations, taken as one cycle, were repeated three times, and the water repellency and the oil repellency as measured thereafter were taken as expressing the resistance to laundering.

Resistance to dry cleaning was determined by stirring a cloth previously applied with the test material in perchloroethylene containing potassium oleate at 30° C. for 1 hour in a laundry tester and drying the cloth in atmosphere and then at 80° C. for 3 minutes. The above operations, taken as one cycle, were repeated three times, and the water repellency and the oil repellency as measured thereafter were taken as expressing the resistance to dry cleaning.

Reference Example 1

A compound of the formula: $(CF_3)_2CF(CF_2CF_2)_n$-$CH_2CH_2OOCCH{=}CH_2$ (a mixture of n=3, n=4 and n=5 in a weight ratio of 5:3:1) (60 g), $C_{18}H_{37}OOCCH{=}CH_2$ (38 g), $CH_2{=}CHCOOCH_2C$-$H(OH)CH_2Cl$ (2 g), deoxygenated and deionized water (250 g), acetone (50 g), n-dodecylmercaptan (0.2 g), dimethylalkylamine acetate (3 g) and polyoxyethylenealkyl phenol (3 g) were charged in a flask and stirred at 60° C. for 1 hour under nitrogen stream. After addition of azobisisobutylamidine hydrochloride (1 g) in water (10 g) thereto, stirring was continued at 60° C. for 5 hours under nitrogen stream, whereby polymerization proceeded. The conversion was confirmed to be more than 99% by gas chromatography. The obtained emulsion contained the copolymer of 25% by weight.

Refernece Example 2

A compound of the formula: $(CF_3)_2CF(CF_2CF_2)_n$-$CH_2CH_2OOCCH{=}CH_2$ (a mixture of n=3, n=4 and n=5 in a weight ratio of 5:3:1) (60 g), $C_{18}H_{37}OOCCH{=}CH_2$ (38 g), $CH_2{=}CHCOOCH_2C$-$H(OH)CH_2Cl$ (2 g) and 1,1,1-trichloroethane (550 g) were charged in a flask and stirred at 60° C. for 30 minutes under nitrogen stream. After addition of azobisisobutyronitrile (1 g) thereto, stirring was continued for 12 hours under nitrogen stream, whereby polymerization proceeded. The conversion was confirmed to be more than 99% by gas chromatography. The obtained solution contained the copolymer of 15% by weight.

Examples 1 to 9 and Comparative Examples 1 to 6

In the same manner as in Reference Example 1, the copolymer having the composition as described in each Example or Comparative Example was prepared in the form of emulsion. The produced emulsion was diluted with water to make a dilution having a solid content of 0.5% by weight. Into the dilution, a cloth consisting of cotton fibers and polyester fibers in a weight ratio of 35:65 was dipped. The dipped cloth was squeezed by the aid of roll and dried at 80° C. for 3 minutes and then at 150° C. for 3 minutes.

The thus treated cloth was subjected to the tests for determination of the water repellency and the oil repellency. Also, it was subjected to the tests for resistance to laundering and dry cleaning. The results are shown in Table 3.

EXAMPLE 1

| | Parts by weight |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCCH{=}CH_2$ | 39 |
| $CH_2CHCOOCH_2CH(OH)CH_2Cl$ | 1 |

EXAMPLE 2

| | Parts by weight |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}CHCOOCH_2CH(OH)CH_2Cl$ | 2 |

EXAMPLE 3

| | Parts by weight |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCCH{=}CH_2$ | 36 |
| $CH_2{=}CHCOOCH_2CH(OH)CH_2Cl$ | 4 |

EXAMPLE 4

| | Parts by weight |
|---|---|
| $(CF_3)_2CF(CF_2CF_2)_nCH_2CH_2OOCC(CH_3){=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}CHCOOCH_2CH(OH)CH_2Cl$ | 2 |

EXAMPLE 5

| | Parts by weight |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCC(CH_3){=}CH_2$ | 38 |
| $CH_2{=}CHCOOCH_2CH(OH)CH_2Cl$ | 2 |

EXAMPLE 6

| | Parts by weight |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}C(CH_3)COOCH_2CH(OH)CH_2Cl$ | 2 |

EXAMPLE 7

| | Parts by weight |
|---|---|
| $CF_3CF_2(CF_2CF_2)_nCH_2CH_2OOCC(CH_3){=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}CHCOOCH_2CH(OH)CH_2Cl$ | 2 |

EXAMPLE 8

| | Parts by weight |
|---|---|
| $OOCCH_3$ | |

-continued

| | Parts by weight |
|---|---|
| $(CF_3)_2CF(CF_2CF_2)_nCH_2CHCH_2OOCC(CH_3){=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}C(CH_3)COOCH_2CH(OH)CH_2Cl$ | 2 |

EXAMPLE 9

| | Parts by weight |
|---|---|
| $C_8F_{17}SO_2N(C_2H_5)C_2H_4OOCCH{=}CH_2$ | 60 |
| $C_{18}H_{37}OOCC(CH_3){=}CH_2$ | 38 |
| $CH_2{=}CHCOOCH_2CH(OH)CH_2Cl$ | 2 |

COMPARATIVE EXAMPLE 1

| | Parts by weight |
|---|---|
| $(CF_3)_2CF(CF_2CF_2)_nCH_2CH_2\ OOCCH{=}CH_2$ (a mixture of n = 3, n = 4 and n = 5 in a weight ratio of 5:3:1) | 60 |
| $C_{18}H_{37}OOCCH{=}CH_2$ | 40 |

COMPARATIVE EXAMPLE 2

| | Parts by weight |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}C(CH_3)COOCH_2CH_2OH$ | 2 |

COMPARATIVE EXAMPLE 3

| | Parts by weight |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}C(CH_3)COOCH_2CH(OH)CH_3$ | 2 |

COMPARATIVE EXAMPLE 4

| | |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}CHCOOCH_2CH(OH)CH_3$ | 2 |

COMPARATIVE EXAMPLE 5

| | |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}C(CH_3)COOC_2H_4Cl$ | 2 |

COMPARATIVE EXAMPLE 6

| | Parts by weight |
|---|---|
| $(CF_3)_2CF(CF_2CF_2)_nCH_2CH_2OOCCH{=}CH_2$ (a mixture of n = 3, n = 4 and n = 5 in a weight ratio of 5:3:1) | 60 |
| $C_{18}H_{37}OOCCH{=}CH_2$ | 38 |
| $CH_2{=}C(CH_3)COOC_2H_4OH$ | 1 |
| $CH_2{=}C(CF_3)COOC_2H_4Cl$ | 1 |

TABLE 3

| | Initial | | Laundered | | Dry cleaned | |
|---|---|---|---|---|---|---|
| | Water-repellency | Oil-repellency | Water-repellency | Oil-repellency | Water-repellency | Oil-repellency |
| Example 1 | 100 | 120 | 90 | 100 | 90 | 90 |
| 2 | 100 | 120 | 100 | 100 | 100 | 100 |
| 3 | 90 | 120 | 80 | 100 | 90 | 90 |
| 4 | 100 | 120 | 100 | 100 | 100 | 100 |
| 5 | 100 | 120 | 100 | 100 | 100 | 100 |
| 6 | 100 | 120 | 100 | 100 | 100 | 100 |
| 7 | 100 | 120 | 100 | 110 | 100 | 100 |
| 8 | 100 | 100 | 80 | 90 | 100 | 80 |
| 9 | 100 | 130 | 90 | 110 | 80 | 90 |
| Comparative Example 1 | 80 | 100 | 70 | 80 | 50 | 70 |
| 2 | 90 | 110 | 80 | 80 | 70 | 80 |
| 3 | 90 | 110 | 80 | 90 | 70 | 80 |
| 4 | 90 | 110 | 80 | 90 | 80 | 80 |
| 5 | 80 | 100 | 70 | 80 | 50 | 70 |
| 6 | 90 | 100 | 80 | 80 | 70 | 70 |

What is claimed is:

1. A water and oil repellent consisting essentially of a copolymer comprising units of (a) at least 25% by weight of at least one of perfluoroalkyl group-containing acrylates and methacrylates and of (b) from 0.1 to 10% by weight of at least one of 2-hydroxy-3-chloropropyl acrylate and methacrylate of the formula:

$$CH_2{=}CRCOOCH_2CH(OH)CH_2Cl$$

wherein R is hydrogen or methyl.

2. The water and oil repellent according to claim 1, wherein the copolymer comprises, in addition to the components (a) and (b), units of (c) at least one of other polymerizable compounds having no fluoroalkyl group in an amount of from 5 to 74.9% by weight.

3. A water and oil repellent composition which comprises a copolymer comprising units of (a) at least 25% by weight of at least one of perfluoroalkyl group-containing acrylates and methacrylates and of (b) from 0.1 to 10% by weight of at least one of 2-hydroxy-3-chloropropyl acrylate and methacrylate of the formula:

$$CH_2{=}CRCOOCH_2CH(OH)CH_2Cl$$

wherein R is hydrogen or methyl.

4. The water and oil repellent composition according to claim 3, wherein the copolymer comprises additionally units of (c) at least one of other polymerizable compounds having no fluoroalkyl group in an amount of from 5 to 74.9% by weight.

5. The water and oil repellent according to claim 2, wherein the other polymerizable compounds having no fluoroalkyl group are stearyl acrylate and/or stearyl methacrylate.

6. The water and oil repellent according to claim 4, wherein the other polymerizable compounds having no fluoroalkyl group are stearyl acrylate and/or stearyl methacrylate.

* * * * *